US011781271B2

(12) United States Patent
Faucher et al.

(10) Patent No.: US 11,781,271 B2
(45) Date of Patent: Oct. 10, 2023

(54) INCREASING PAPER STRENGTH BY SURFACE TREATMENT

(71) Applicant: S.P.C.M. SA, Andrezieux-Boutheon (FR)

(72) Inventors: Gatien Faucher, Andrezieux (FR); Damien Fougerouse, Andrezieux (FR); René Hund, Andrezieux (FR)

(73) Assignee: S.P.C.M. SA, Andrezieux-Boutheon (FR)

( * ) Notice: Subject to any disclaimer, the term of this patent is extended or adjusted under 35 U.S.C. 154(b) by 186 days.

(21) Appl. No.: 17/437,496

(22) PCT Filed: Mar. 13, 2020

(86) PCT No.: PCT/EP2020/056774

§ 371 (c)(1),
(2) Date: Sep. 9, 2021

(87) PCT Pub. No.: WO2020/182977

PCT Pub. Date: Sep. 17, 2020

(65) Prior Publication Data

US 2022/0162803 A1 May 26, 2022

(30) Foreign Application Priority Data

Mar. 14, 2019 (FR) ..... 1902634

(51) Int. Cl.
*D21H 19/12* (2006.01)
*D21H 21/20* (2006.01)

(52) U.S. Cl.
CPC ..... *D21H 19/12* (2013.01); *D21H 21/20* (2013.01)

(58) Field of Classification Search
CPC ..... D21H 17/37; D21H 17/24; D21H 17/66; D21H 17/00; D21H 21/18; D21H 21/20; D21H 19/12
USPC ..... 162/135
See application file for complete search history.

(56) References Cited

U.S. PATENT DOCUMENTS

| | | | |
|---|---|---|---|
| 7,074,845 | B2 | 7/2006 | Laleg |
| 7,625,962 | B2 | 12/2009 | Laleg |
| 8,354,004 | B2 | 1/2013 | Laleg |
| 2001/0051687 | A1 | 12/2001 | Bazaj et al. |
| 2003/0188738 | A1 | 10/2003 | Laleg |
| 2005/0252629 | A1 | 11/2005 | Laleg |
| 2010/0078138 | A1 | 4/2010 | Laleg |
| 2011/0091733 | A1 | 4/2011 | Feuerhake |

OTHER PUBLICATIONS

Preliminary Search Report for FR 1902634 dated Jul. 19, 2009.
International Search Report for PCT/EP2020/056774 dated Apr. 8, 2020.

*Primary Examiner* — Mark Halpern
(74) *Attorney, Agent, or Firm* — B. Aaron Schulman, Esq.; Stites & Harbison, PLLC

(57) ABSTRACT

This method for treating the surface of paper and/or one of the layers thereof, comprises the following successive steps:

i) Supplying an aqueous suspension S of polysaccharide;
ii) Supplying an aqueous dispersion D comprising (a) particles of at least one anionic water-swellable polymer P and (b) at least one compound selected from a mineral salt, an organic salt, an organic dispersing polymer and the mixtures thereof;
iii) Mixing the suspension S and the dispersion D to obtain a mixture M;
iv) Applying the mixture M to the surface of the paper and/or to at least one of the layers thereof.

14 Claims, No Drawings

INCREASING PAPER STRENGTH BY SURFACE TREATMENT

This application is a 371 of PCT/EP2020/056774 filed on 13 Mar. 2020

FIELD OF THE INVENTION

The invention concerns a method for treating the surface of paper to improve the mechanical strength thereof.

STATE OF THE PRIOR ART

For paper and/or paperboard produced by superimposing layers of paper, it is important to obtain an adhesive force between the layers to improve cohesion within the thickness of paper. Formerly, starches such as corn starch, wheat starch, potato starch or chemically modified starches were used as agents to reinforce binding of the layers. Practice involved depositing/spraying the starch suspension onto wet paper and promoting gelatinization of the starch during the drying process to improve adhesive force.

However, a drop in the mechanical performance of paper is observed if the drying profile is too harsh, since it generates rapid removal of water from the starch slurry deposited on the surface of the paper.

Starch granules require a high temperature, water and time to «burst/explode» to achieve gelatinization of the starch. It is the gelatinized starch which provides the mechanical properties. If the slurry water deposited on the surface is removed too quickly through a drying profile that is too harsh, or if absorption of water within the paper is too rapid, the granules dry as such without gelatinizing and hence fail to perform.

More recently, a dry strength agent of polyacrylamide (PAM) type has been used in combination with starch. With synthetic macromolecules of PAM type, it has become possible to minimize the problems related to the use of an aqueous starch solution e.g. increased COD (Chemical Oxygen Demand), the formation of mould/bacteria derived from natural substances such as starch, heavy maintenance required of spray nozzles. It also limits starch losses within the paper and in the water circuit.

Nevertheless, up until now, all dry strength agents tested in combination with starch have been water-soluble polymers.

DESCRIPTION OF THE INVENTION

The Applicant has surprisingly discovered that by applying to the surface of paper and/or to at least one of the layers thereof a mixture of a polysaccharide and an aqueous dispersion comprising (a) particles of at least one anionic water-swellable polymer and (b) at least one compound selected from among a mineral salt, an organic salt, an organic dispersing polymer and mixtures thereof, greater mechanical properties against delamination are obtained. Without wishing to be bound by any theory, it would appear that the water-retaining capacity of the water-swellable polymer imparts a moist atmosphere to the starch granules that is more resilient to drastic drying conditions, thereby improving gelatinization of the starch.

The invention therefore concerns a method for treating the surface of paper and/or at least one of the layers thereof, comprising the following successive steps:

i) Supplying an aqueous suspension S of polysaccharide;

ii) Supplying an aqueous dispersion D comprising (a) particles of at least one anionic water-swellable polymer P and (b) at least one compound selected from a mineral salt, an organic salt, an organic dispersing polymer and the mixtures thereof;

iii) Mixing the suspension S and the dispersion D to obtain a mixture M;

iv) Applying the mixture M to the surface of the paper and/or to at least one of the layers thereof.

The method of the invention can be implemented on wet or dry paper, preferably wet. In the invention, by wet paper it is meant paper leaving the production process before it enters the dryer.

Advantageously, the aqueous suspension S contains between 0.5 and 30 weight ')/0 of polysaccharide in water, and more advantageously between 5 and 20 weight')/0.

Preferably, the polysaccharide is selected from among native starch, amylose, amylopectin, cellulose and compounds derived from cellulose, modified starches such as enzymatically treated starch, hydrolysed starches, heated starches, cationic starches such as those resulting from the reaction of a starch with a tertiary amine to form a quaternary ammonium starch, anionic starches, amphoteric starches; and any combination thereof.

Preferably, the polysaccharide is native starch. Native starch is the product of starch extraction without subsequent modification.

The water-swellable polymer P used at step ii) of the method of the invention is also known as a super-absorbent polymer. In general, it has a water-absorbing capacity greater than 10 times its own volume. In particularly advantageous manner for the method of the invention, within the dispersion, the water-swellable polymer is not or only scarcely water-swollen. Scarcely water-swollen means that it maintains a water absorption capacity greater than 10 times its own volume.

The water-swellable polymer P used at step ii) of the method of the invention is anionic, which means that its resulting charge is negative. This polymer can be prepared from different water-soluble monomers, in particular from at least one water-soluble monomer comprising at least one ethylenic double bond. It can therefore be prepared from at least one anionic monomer, from at least one nonionic monomer, from at least one cationic monomer or from at least one zwitterionic monomer, alone or in a mixture. In general, the water-swellable polymers P used in the method of the invention are obtained by crosslinking and therefore form three-dimensional networks.

As examples of anionic monomers, advantageous use is made of at least one monomer selected from among:

- monomers comprising at least one carboxylic function e.g. acrylic acid, methacrylic acid, itaconic acid and the salts thereof;
- monomers comprising at least one sulfonic acid function e.g. 2-acrylamido-2-methylpropane sulfonic acid (AMPS), allyl sulfonic acid and methallyl sulfonic acid, and the salts thereof.

As examples of nonionic monomers, advantageous use is made of at least one monomer selected from among:

- acrylamide and the derivatives thereof, in particular N-alkylacrylamides e.g. N-isopropylacrylamide, N-tert-butylacrylamide; N,N-dialkylacrylamides e.g. N,N-dimethylacrylamide and N-methylolacrylamide;

methacrylamide and the derivatives thereof, in particular N-alkylmethacrylamides e.g. N-isopropylmethacrylamide, N-tert-butylmethacrylamide; N,N-dialkylmethacrylam ides e.g. N,N-dimethylmethacrylamide and N-methylolmethacrylamide;

vinylformamide, N-vinylpyridine, N-vinylpyrrolidone, hydroxyalkyl acrylates, hydroxyalkyl methacrylates, acrylates carrying alkoxy chains; methacrylates carrying alkoxy chains.

As examples of cationic monomers, advantageous use is made of at least one monomer selected from among:

diallyldialkyl ammonium salts e.g. diallyl dimethyl ammonium chloride (DADMAC);

dialkylaminoalkyl, acrylates dialkylaminoalkyl methacrylates in particular dimethylaminoethyl acrylate (DMAEA) and dimethylaminoethyl methacrylate (DMAEMA) and the acidified or quaternized forms thereof e.g. [2-(acryloyloxy)ethyl] trimethylammonium chloride; dialkyl-aminoalkylacrylamides, dialkyl-methacrylamides and the acidified or quaternized forms thereof e.g. acrylamido-propyl trimethyl ammonium chloride.

As examples of zwitterionic monomers, advantageous use is made of at least one monomer selected from among:

sulfobetaine monomers such as sulfopropyl dimethylammonium ethyl methacrylate, sulfopropyl dimethylammonium propylmethacrylamide, sulfopropyl 2-vinylpyridinium;

phosphobetaine monomers such as phosphate-ethyl trimethylammonium ethyl methacrylate, carboxybetaine monomers.

Advantageously, at step ii) of the method of the invention, the water-swellable polymer P can be a copolymer prepared from the previously described monomers of from the previously described monomers with at least one other monomer selected from among hydrophobic monomers e.g. styrene, alkyl-acrylates, alkyl-methacrylates, aryl-acrylates, aryl-methacrylates, hydrophobic derivatives of acrylamide; amphiphilic monomers e,g. dodecyl poly(oxyethylene) methacrylate, behenyl poly(oxyethylene) methacrylate; or from natural polymers such as cellulose derivatives, polysaccharides, clays, for example these natural polymers can be grafted onto the water-swellable polymers of the invention to form another family of water-swellable polymers of the invention.

Advantageously, the water-swellable polymer P is a copolymer of at least one nonionic monomer and at least one anionic monomer. Preferably, the anionic water-swellable polymer P is derived from at least 1 mol % of at least one anionic water-soluble monomer comprising an ethylenic double bond and at least one carboxylic or sulfonic acid function and from at least 5 mol % of at least one nonionic monomer selected from among acrylamide, methacrylamide and the derivatives thereof, vinylformamide and N-vinylpyrrolidone.

Preferably, the water-swellable polymer P contains between 1 and 40 mol % of at least one anionic water-soluble monomer comprising an ethylenic double bond and at least one carboxylic or sulfonic acid function and between 60 and 99 mol % of at least one nonionic monomer selected from among acrylamide, methacrylamide and the derivatives thereof, vinylformamide and N-vinylpyrrolidone.

In one preferred embodiment, the anionic water-soluble monomer is selected from among acrylic acid, methacrylic acid and the salts thereof, 2-acrylamido-2-methylpropane sulfonic acid and the salts thereof, itaconic acid and the salts thereof, allyl sulfonic acid and the salts thereof, methallyl sulfonic acid and the salts thereof.

Further preferably, the anionic water-swellable polymer P is a copolymer of acrylamide and sodium acrylate.

In one preferred embodiment, for the method of the invention, the aqueous dispersion D comprises from 5 to 60 dry weight %, and more preferably from 15 to 35 dry weight % of water-swellable polymer P.

For the method of the invention, the particles of water-swellable polymer P advantageously have a diameter allowing dispersion thereof. Preferably, the particles have a mean diameter ranging from 0.1 to 1 000 μm, more preferably ranging from 0.1 to 200 μm, further preferably ranging from 0.1 to 20 μm. The mean diameter of the particles can be determined using any method known to persons skilled in the art, for example under binocular microscopy.

In addition to the water-swellable polymer P, the aqueous dispersion D comprises a compound (b) having the function of an equilibrating agent. This is a water-soluble or water-miscible compound. In the dispersion of the invention, it allows the water-swelling capacity of the polymer P to be fully or partially inhibited. Therefore, in this aqueous dispersion, in the presence of this compound (b), the water-swellable polymer (P) is in the form of particles and is not or only slightly in the water-swollen state.

Preferably, the aqueous dispersion comprises at least one compound (b) selected from among:

mineral or organic salts comprising at least one anion selected from among sulfates, dihydrogen phosphates, phosphates, halides;

mineral or organic salts comprising at least one cation selected from among sodium, potassium, ammonium, magnesium, calcium, aluminium;

mixtures of at least two of these salts;

organic dispersing polymers selected from among polymers or copolymers of acrylic acid, 2-acrylamido-2-methylpropane sulfonic acid and the salts thereof, and of acrylamide having a molecular weight ranging from 1000 to 30 000 $g \cdot mol^{-1}$.

Preferably, the dispersion D as compound (b) comprises from 8 to 27 weight % of mineral salt or organic salt and from 5 to 20 dry weight % of organic dispersing polymer.

In the invention, the dispersion D may also comprise at least one additive selected from among polyfunctional alcohols e.g. glycerol, polyalkylene glycols such as polyethylene glycol and polypropylene glycol. Advantageously, the additive is contained in a weight amount of the dispersion ranging from 0.001 to 20 weight %, preferably from 0.5 to 10%

The mixture M of the suspension S and dispersion D, is advantageously obtained under agitation by adding the dispersion D to the suspension S, so that the concentration of the polymer P in M is between 0.001 and 10 dry weight %.

For step iv) of the method of the invention, the application of the mixture M (S+D) to the surface of paper and/or to at least one of the layers thereof, also called paper coating, can be carried out using any coating means. Preferably, these coating means are a size press or spray bar. Several types of size presses exist including roll size presses, blade size presses, rotating bar size presses, curtain size presses and vacuum size presses.

Finally, in a last preference, step iv) of the method of the invention which consists of applying the mixture M, is conducted at a temperature of between 10 and 100° C. and more preferably between 30° C. and 100° C.

The mixture M advantageously allows an improvement in the mechanical strength of the paper. Therefore, preferably, the present invention concerns a method for improving the mechanical strength of paper comprising the application of a mixture M of the invention to the surface of paper, and/or at least to one of the layers thereof.

The present invention also concerns the use of a water-swellable polymer P of the invention to treat paper, in particular the use of a water-swellable polymer P in combination with a polysaccharide to treat paper, in particular to improve the mechanical strength of paper.

The present invention also concerns the use of the mixture M to treat paper, in particular to improve the mechanical strength of paper.

The invention and resulting advantages will become clear from the following examples of embodiment.

EXAMPLES

Formation of Sheets with Deposition in Spray Form onto Wet Sheets.

The paper handsheets were formed in an automatic dynamic handsheet former. First the paper pulp was prepared by disintegrating, for 25 minutes, 90 grams of recycled paperboard fibres in 2 litres of hot water (pulp of neutral pH composed of 100% recycled fibres). The pulp obtained was diluted in water up to a volume of 6 litres. After precise measurement of consistency, the necessary amount of this pulp was taken for the final obtaining of a sheet of 90 g/m$^2$ gram weight.

The pulp was placed in the vat of the dynamic handsheet former, diluted to a consistency of 0.5% and moderately stirred with a mechanical stirrer to homogenize the aqueous suspension.

A blotter and forming fabric were placed in the drum of the dynamic sheet former before setting the drum in rotation at 1000 rpm and constructing the water wall. The sheet was formed by 23 return scans of the nozzle projecting the pulp into the water wall. After the water had drained and the automatic sequence was completed, the forming fabric together with the formed network of fibres was removed from the drum of the dynamic sheet former and placed on a table. A dry blotter was placed on the side of the mat of wet fibres and pressed once with a roller. The assembly was turned over and the forming fabric gently separated from the fibrous mat. A second dry blotter was deposited before turning over the assembly again and removing the first blotter saturated with water.

In spray form (using a spray gun, bar, nebulizer . . . ) an aqueous suspension of raw native starch was applied with or without the addition of the polymer of the invention, to obtain a uniform dry deposit of approximately 1 g/m$^2$.

The wet sheet was folded in half on the treated surface, pressed between two rolls at a pressure of 4 bar and, after renewing the blotter, the sheet was dried on a taut dryer for 10 minutes at 117° C. The blotter was removed and the sheet thus formed was conditioned for a minimum time of 12 hours in a room under controlled humidity and temperature (50 relative humidity and temperature of 23° C.).

The dry strength properties of the different sheets obtained with this procedure were evaluated.

Deposition with Grooved Metering Rod on Dry Sheet

Industrial flat paperboard was used with a grooved rod to deposit an aqueous suspension S of raw native starch with or without the addition of polymer dispersion D (the suspension S with the addition corresponds to the mixture M). This sheet was folded in half on the treated surface, placed in a blotter, pressed between two rolls at a pressure of 4 bar and dried on a taut dryer for 10 minutes at 117° C. The blotter was then removed and the formed sheet was conditioned for a minimum time of 12 hours in a room under controlled humidity and temperature (50% relative humidity and temperature of 23° C.).

The dry strength properties of the different sheets obtained with this procedure were evaluated.

The equipment used for deposition on dry sheets was a laboratory size press of the type Multicoater K 303 by RK Print Coat Instruments.

Dry Strength Tests:

Bursting strength was measured with a Messmer Buchel M 405 burst tester (mean of 12 values), in accordance with standard TAPPI T403 om-02. The result is expressed in kPa. The Burst Index was determined, expressed in kPa·m$^2$/g, by dividing this value by sheet grammage.

The internal cohesion test was conducted with apparatus of Scott Bond type (mean of 5 values) in accordance with TAPPI T569 pm-00 procedure. The result is expressed in ft. lbs/int.

Compositions Used in the Following Examples:

TABLE 1

| Composition | Description |
|---|---|
| E (Example) | Aqueous dispersion containing 20 weight % of a water-swellable polymer P1 of acrylamide and crosslinked sodium acrylate, of particle size less than 50 μm. This aqueous dispersion contains a total of 43 weight % of dry matter particularly including the water-swellable polymer, ammonium sulfate and dispersing polymers. |
| C (Counter-example) | Aqueous dispersion containing 20 weight % of a water-soluble polymer P2 of acrylamide and sodium acrylate, of particle size less than 50 μm. This aqueous dispersion contains a total of 43 weight % of dry matter particularly including the water-soluble polymer, ammonium sulfate and dispersing polymers. |

Differentiation, compositions E and C: The compositions were diluted to 5 g/L in deionized water. For composition E, a turbid suspension was obtained which was left to settle in a tube until an opalescent deposit was obtained at the bottom of the tube and a limpid supernatant. The opalescent deposit represents the accumulation of particles of water-swellable polymer P1.

For composition C, dilution to 5 g/L led directly to a limpid, viscous solution. The polymer P2 was completely dissolved.

Example 1

Deposition with a Laboratory Size Press onto Dry Sheet

Industrial flat paperboard of 110 g/m$^2$ was used having mechanical performance corresponding to the «blank» test when not treated.

As reference test, this paperboard was coated in a laboratory size press (grooved rod n° 3) with native wheat starch milk having 18% dry matter.

This last operation was reproduced, all else being equal, by previously preparing before deposition the mixtures of native wheat starch milk/polymer dispersion so as to substitute 5% of the starch dry matter by the same quantity of dry matter of polymer P1 or P2 (by adding the respective required amounts of compositions E and C).

TABLE 2

| | Internal cohesion (ft · lbs/in$^2$) | Burst Index | % burst improvement/ Blank |
|---|---|---|---|
| Blank | NA | 1.82 | NA |
| Starch (100%) | 30 | 2.13 | 17.0 |
| Starch/P2 (95/5) | 105 | 2.37 | 29.9 |
| Starch/P1 (95/5) | 140 | 2.59 | 41.9 |

The adding of synthetic polymers to native starch brings undeniable gains in paper performance in terms of dry strength, here resistance to delamination (internal cohesion) and burst strength.

Above all, the advantage is clearly seen here of using the water-swellable polymer P1 in lieu and stead of the water-soluble polymer P2.

Example 2

Deposition by Spraying onto Wet Sheet:

Three sheets were prepared following the above-described procedure:

a first sheet without treatment (Blank);

the second by depositing the equivalent of 0.38 g/m$^2$ of native wheat starch;

the third by depositing the equivalent of 0.374 g/m$^2$ of a mixture of native wheat starch/P1 (90/10), i.e. respective deposition of 0.34 g/m$^2$+0.034 g/m$^2$.

TABLE 3

| | Internal cohesion (ft · lbs/in$^2$) | Burst Index |
|---|---|---|
| Blank | 50 | 2.28 |
| Starch (0.38 g/m$^2$) | 95 | 2.41 |
| Starch (0.34 g/m$^2$) P1 (0.034 g/m$^2$) | 110 | 2.57 |

Performance in terms of internal cohesion and burst strength are clearly improved by substituting 10% of native starch by the same amount of water-swellable polymer P1.

The invention claimed is:

1. A method for treating the surface of paper and/or at least one of the layers thereof, comprising:

i) supplying an aqueous suspension S of polysaccharide;

ii) supplying an aqueous dispersion D comprising (a) particles of at least one anionic water-swellable polymer P and (b) at least one compound selected from a mineral salt, an organic salt, an organic dispersing polymer and the mixtures thereof;

iii) mixing the suspension S and the dispersion D to obtain a mixture M; and iv) applying the mixture M to the surface of the paper and/or to at least one of the layers thereof.

2. The method according to claim 1, wherein the polysaccharide is selected from the group consisting of native starch, amylose, amylopectin, cellulose and compounds derived from cellulose, modified starches, enzymatically treated starches, hydrolysed starches, heated starches, cationic starches, starches resulting from the reaction of a starch with a tertiary amine to form a quaternary ammonium salt, anionic starches, amphoteric starches; and any combination thereof.

3. The method according to claim 1, wherein the anionic water-swellable polymer P is derived from at least 1 mol % of at least one anionic water-soluble monomer comprising an ethylenic double bond and at least one carboxylic or sulfonic acid function and from at least 5 mol % of at least one nonionic monomer selected from the group consisting of acrylamide, methacrylamide and derivatives thereof, vinylformamide and N-vinylpyrrolidone.

4. The method according to claim 1, wherein at least one anionic water-swellable polymer P is derived from an anionic water-soluble monomer is-selected from the group consisting of acrylic acid, methacrylic acid and the salts thereof, 2-acrylamido-2-methylpropane sulfonic acid and the salts thereof, itaconic acid and the salts thereof, allyl sulfonic acid and the salts thereof, methallyl sulfonic acid and the salts thereof.

5. The method according to claim 1, wherein the anionic water-swellable polymer P is a copolymer of acrylamide and sodium acrylate.

6. The method according to claim 1, wherein the dispersion D comprises from 5 to 60 weight % of anionic water-swellable polymer P.

7. The method according to claim 1, wherein the particles of aqueous dispersion D have a mean diameter ranging from 0.1 to 1 000 μm.

8. The method according to claim 1, wherein the dispersion D comprises at least one compound (b) selected from the group consisting of:

mineral or organic salts comprising at least one anion selected from the group consisting of sulfates, dihydrogen phosphates, phosphates, and halides;

mineral or organic salts comprising at least one cation selected from the group consisting of sodium, potassium, ammonium, magnesium, calcium, and aluminium;

mixtures of at least two of aid mineral or organic salts; and organic dispersing polymers selected from the group consisting of polymers or copolymers of acrylic acid, 2-acrylamido-2-methylpropane sulfonic acid and the salts thereof and acrylamide having a molecular weight ranging from 1000 to 30 000 g.mol$^{-1}$.

9. The method according to claim 1 in which the dispersion D comprises:

from 8 to 27 weight % of mineral salt or organic salt; or from 5 to 20 weight % of organic dispersing polymer.

10. The method according to claim 1, wherein in iv), the application to the surface of paper and/or to at least one of the layers thereof is carried out with a size press or spray bar.

11. The method according to claim 1, wherein in iv) the application to the surface of paper and/or to one of the layers thereof is conducted at a temperature of between 10 and 100° C.

12. The method according to claim 1, wherein the dispersion D comprises from 15 to 35 weight % of anionic water-swellable polymer P.

13. The method according to claim 1, wherein the particles of aqueous dispersion D have a mean diameter ranging from 0.1 to 200 μm.

14. The method according to claim 1, wherein the particles of aqueous dispersion D have a mean diameter ranging from 0.1 to 20 μm.

* * * * *